US007637635B2

(12) United States Patent
Xiao et al.

(10) Patent No.: US 7,637,635 B2
(45) Date of Patent: Dec. 29, 2009

(54) LED LAMP WITH A HEAT SINK

(75) Inventors: Xu-Hua Xiao, Shenzhen (CN); Li He, Shenzhen (CN); Yi-San Liu, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 37 days.

(21) Appl. No.: 11/944,319

(22) Filed: Nov. 21, 2007

(65) Prior Publication Data

US 2009/0129102 A1 May 21, 2009

(51) Int. Cl.
*F21V 29/00* (2006.01)

(52) U.S. Cl. ..... 362/294; 362/373; 362/218

(58) Field of Classification Search ..... 362/218, 362/240, 249.01, 249.02, 294, 373
See application file for complete search history.

(56) References Cited

U.S. PATENT DOCUMENTS 7,549,772 B2 * 6/2009 Wang ..... 362/294
2004/0108104 A1 * 6/2004 Luo ..... 165/181
2005/0174780 A1 * 8/2005 Park ..... 362/294
2006/0001384 A1 1/2006 Tain et al.

FOREIGN PATENT DOCUMENTS

CN 2775467 Y 4/2006
CN 2934916 Y 8/2007

* cited by examiner

*Primary Examiner*—Jong-Suk (James) Lee
*Assistant Examiner*—Julie A Shallenberger
(74) *Attorney, Agent, or Firm*—Frank R. Niranjan

(57) ABSTRACT

An LED lamp includes a heat sink and an LED module. The heat sink includes a body, a plurality of radial partition fins extending evenly from an outer periphery of the body and a curved wall surrounding lower portions of the fins. The fins, the outer periphery of the body and the wall together define a plurality of channels each having a lower opening and a top opening. The LED module includes a plurality of LEDs and is received in the absorbing portion of the body. The LED module is supported by the absorbing portion of the body of the heat sink. Heat generated by the LEDs is transferred to the fins via the body. From the fins, the heat is dissipated to air. The channels each function as a chimney for accelerating heated air to flow upwardly through the fins.

13 Claims, 6 Drawing Sheets

LED LAMP WITH A HEAT SINK

BACKGROUND OF THE INVENTION

1. Field of the Invention

The present invention relates to an LED lamp, and particularly to an LED lamp having a heat sink for heat dissipation.

2. Description of Related Art

The technology of light emitting diode (LED) has been rapidly developed in recent years from indicators to illumination applications. With the features of long-term reliability, environment friendliness and low power consumption, the LED is viewed as a promising alternative for future lighting products. Nevertheless, the rate of heat generation increases with the illumination intensity. This issue has become a challenge for engineers to design the LED illumination, i.e. the LED lamp.

What is needed, therefore, is an LED lamp which has greater heat-transfer and heat dissipation capabilities, whereby the LED lamp can operate normally for a sufficiently long period of time.

SUMMARY OF THE INVENTION

An LED lamp includes a heat sink and an LED module received in the heat sink. The heat sink includes a body, a plurality of radial partition fins extending evenly from an outer periphery of the body and a curved wall surrounding lower portions of the fins. The body includes an absorbing portion and a transferring portion extending upwardly from the absorbing portion. The fins, the outer periphery of the body and the wall together define a plurality of channels each having a lower opening and a top opening. The LED module, which includes a plurality of LEDs, is received in the absorbing portion of the body. The LED module is attached to and thermally connects with the absorbing portion of the body of heat sink. Thus, heat generated by the LEDs can be dissipated by the fins of the heat sink to surrounding air.

BRIEF DESCRIPTION OF THE DRAWINGS

Many aspects of the present LED lamp can be better understood with reference to the following drawings. The components in the drawings are not necessarily drawn to scale, the emphasis instead being placed upon clearly illustrating the principles of the present LED lamp. Moreover, in the drawings, like reference numerals designate corresponding parts throughout the several views.

DETAILED DESCRIPTION OF THE INVENTION

Figure 1:
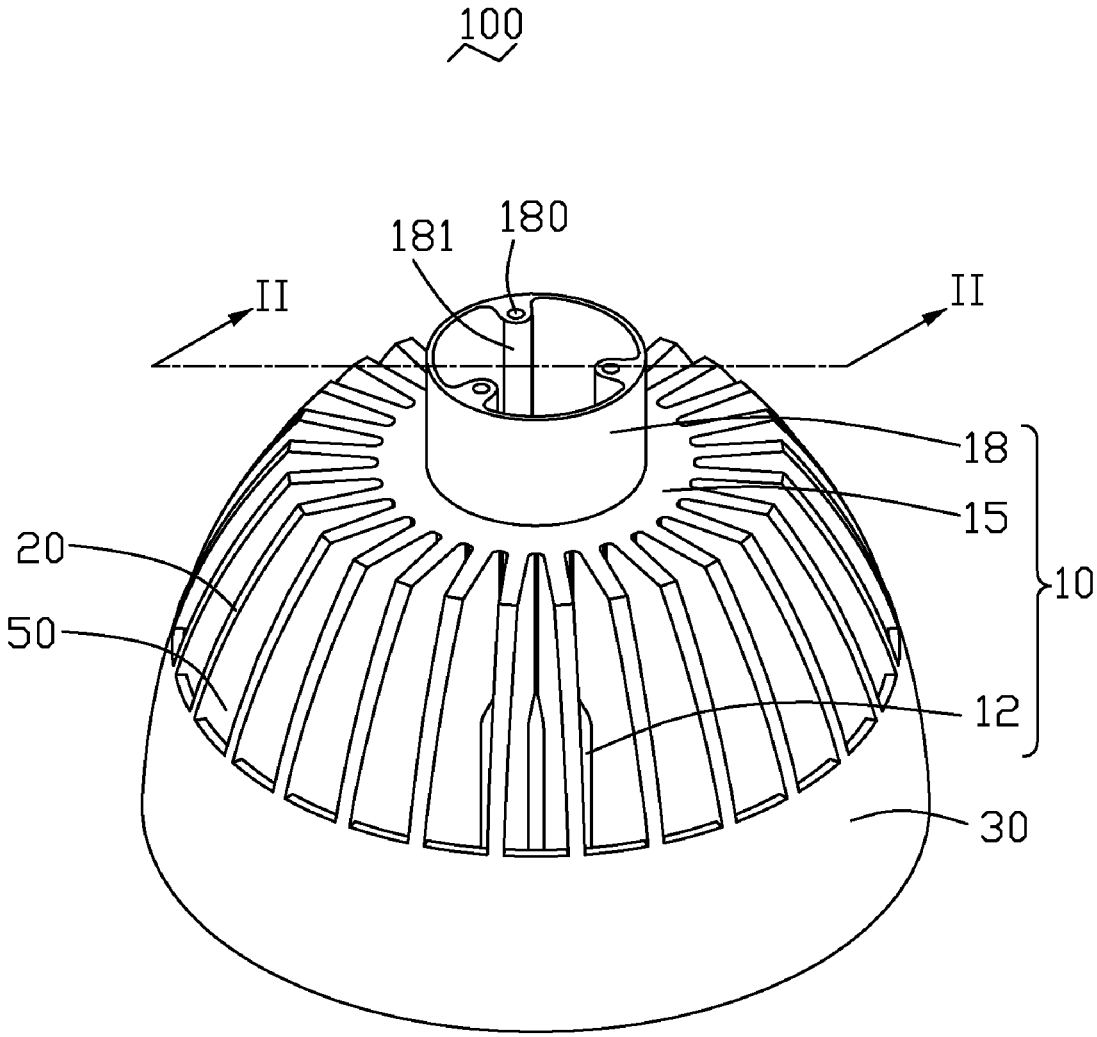
FIG. 1 is an isometric view of an LED lamp in accordance with a preferred embodiment of the present invention.
Figure 2:
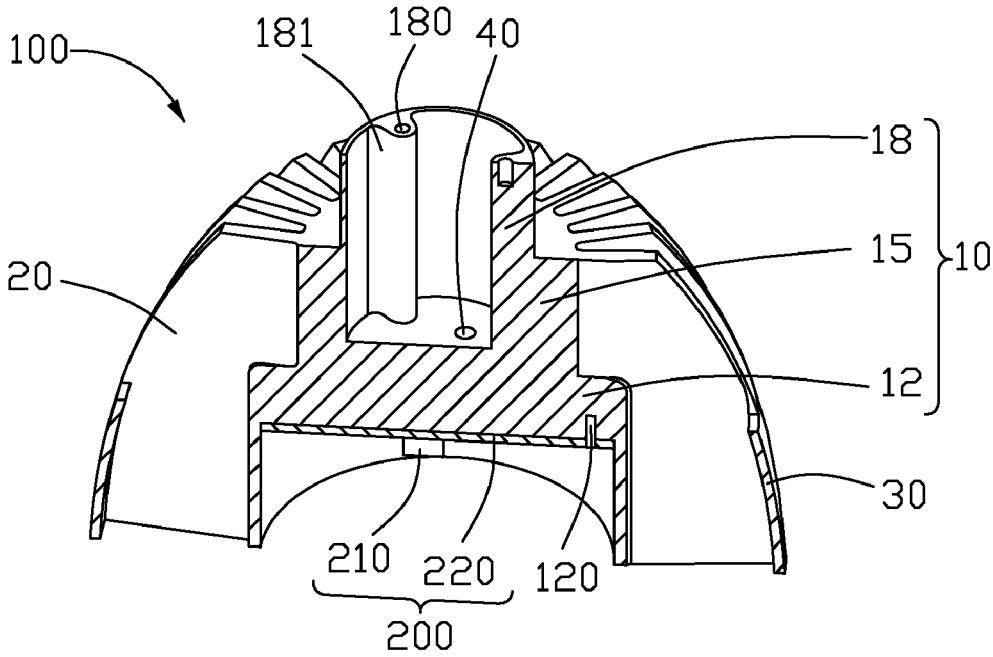
FIG. 2 is a cross-sectional view of the LED lamp of FIG. 1, taken along line II-II thereof.
Figure 3:
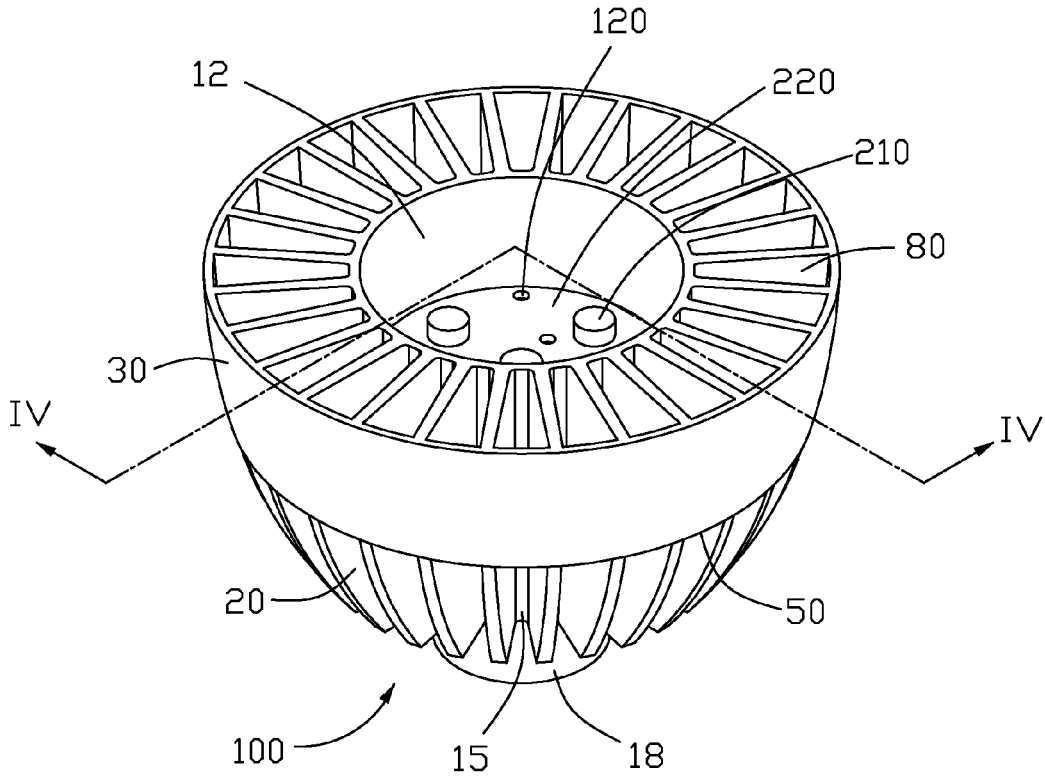
FIG. 3 is an inverted view of FIG. 1.
Figure 4:
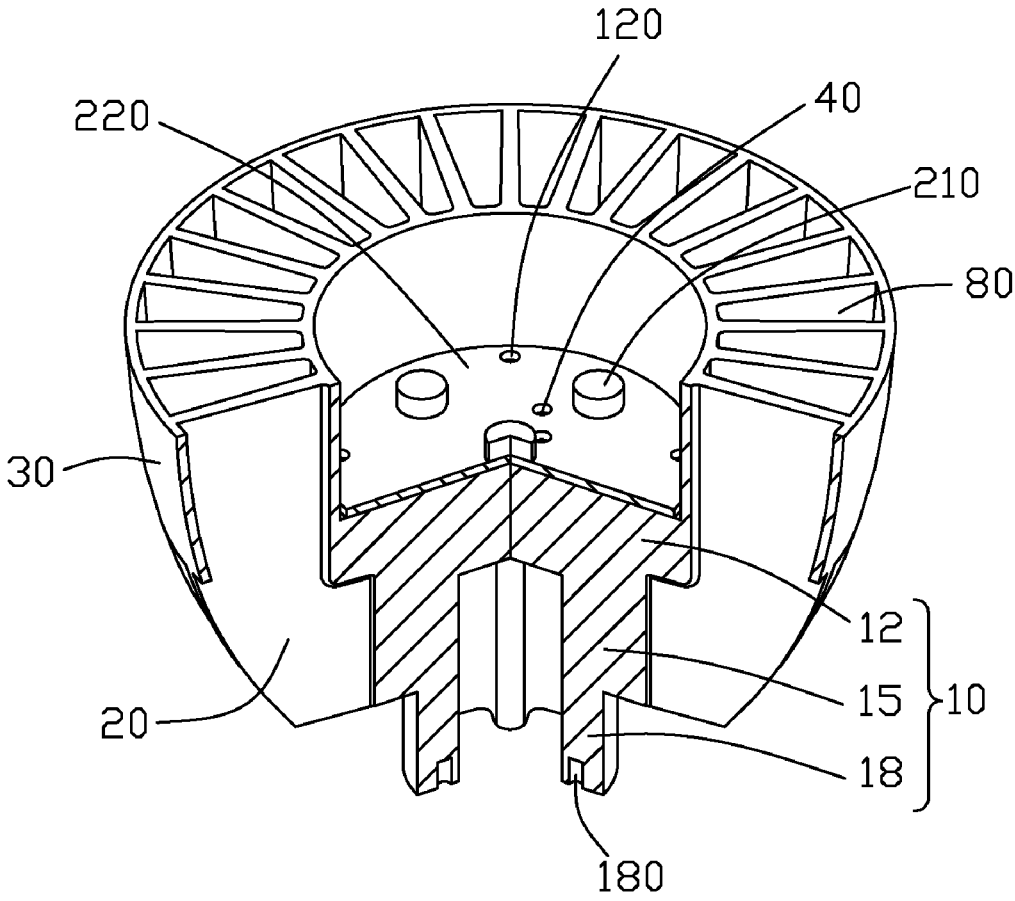
FIG. 4 is a cross-sectional view of the LED lamp of FIG. 3, taken along line IV-IV thereof.
Figure 5:
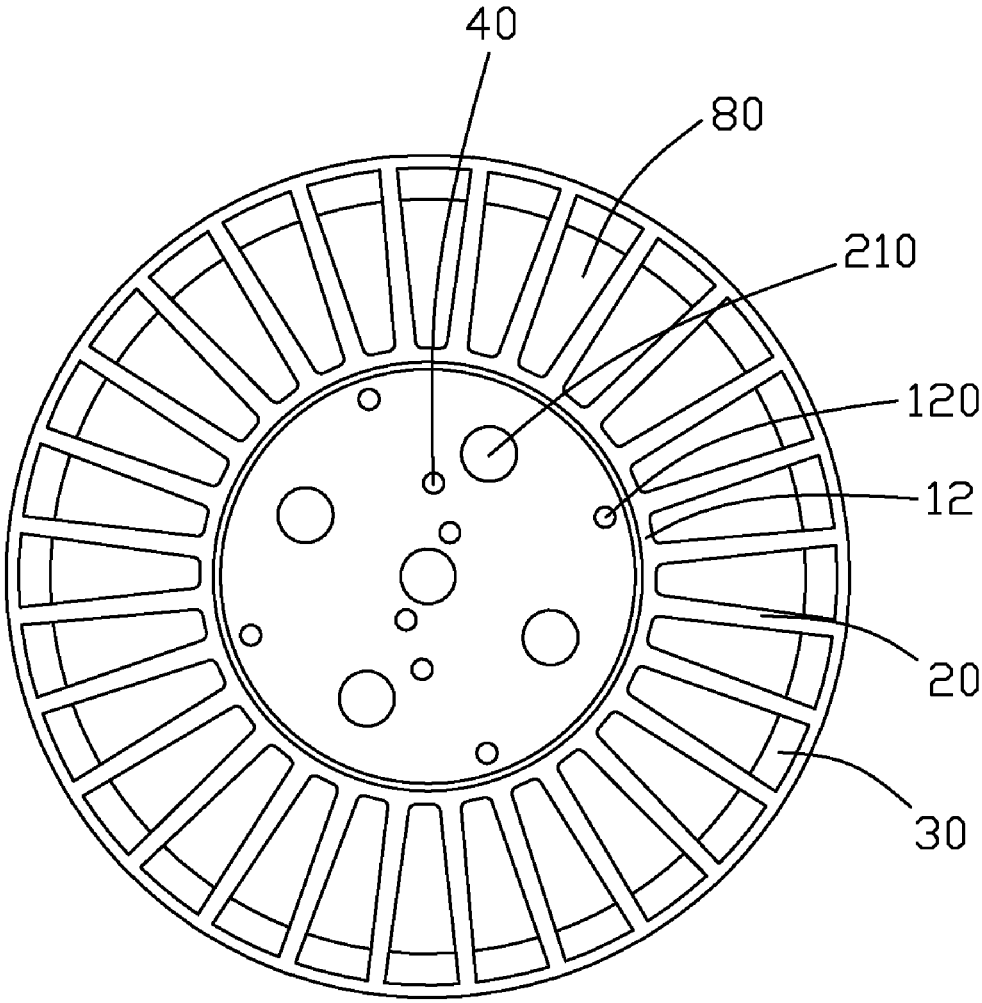
FIG. 5 is a bottom view of FIG. 1.
Figure 6:
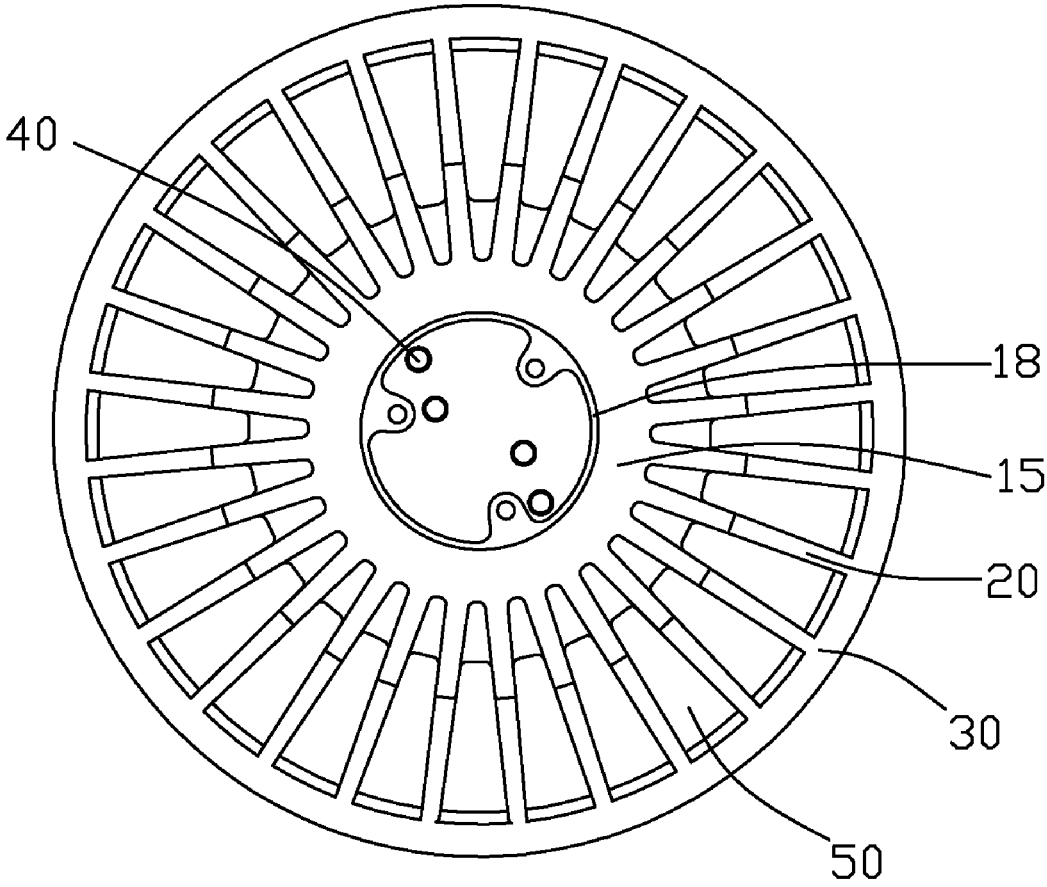
FIG. 6 is a top view of FIG. 1.

Referring to FIGS. 1-2, an LED (light emitting diode) lamp (not labeled) of a preferred embodiment of the invention comprises an LED module 200, a heat sink 100 for supporting and cooling the LED module 200.

The heat sink 100 comprises a heat conducting body 10 receiving the LED module 200 therein, a plurality of radial partition fins 20 extending from an outer surface of the body 10, and a curved wall 30 surrounding lower portions of the fins 20. The wall 30 has a configuration like a hollow frustum.

The body 10 comprises an absorbing portion 12, a transferring portion 15 extending upwardly from an upper portion of the absorbing portion 12, and a mounting portion 18 extending upwardly from an upper portion of the transferring portion 15. The absorbing portion 12 and the transferring portion 15 each have a cylindrical configuration and have a common axis. A diameter of the transferring portion 15 is smaller than that of the absorbing portion 12, and a diameter of the mounting portion 18 is smaller than that of the transferring portion 15, so that the whole body 10 has a step-shaped outer peripheral surface.

The absorbing portion 12 of the body 10 defines a cylindrical cavity in a lower portion thereof so as to form a ceiling (not labeled) therein. The ceiling defines four mounting holes 120 for securing the LED module 200 thereon via four screws (not shown) extending through the LED module 200 and threadedly engaging in the mounting holes 120. The LED module 200 has a printed circuit board 220 to which a plurality of LEDs 210 is attached. The LEDs 210 are oriented downwardly. A cylindrical cavity (not labeled) is downwardly defined in the mounting portion 18 and an upper portion of the transferring portion 15. A plurality of through holes 40 is defined in the transferring portion 15 to communicate the upwardly opened cavity of the mounting portion 18 with the downwardly opened cavity of the absorbing portion 12. The mounting portion 18 and the upper portion of the transferring portion 15 have three connecting ribs 181 extending evenly from an inner surface into the cavity thereof. Each rib 181 has a top defining a fixing hole 180 therein for allowing a fixing member to secure with the mounting portion 18 and connect the LED lamp with a lamp holder (not shown), which is a standard component and available in the market.

The radial partition fins 20 extend evenly and outwardly from an outer surface of the absorbing portion 12 and the transferring portion 15. The fins 20 each have a flat top face coplanar with a top face of the transferring portion 15 and a bottom face coplanar with a bottom face of the absorbing portion 12. The fins 20 each have a convex outer surface, whereby the heat sink 100 in whole has a bowl-shaped configuration. Two neighboring fins 20 are spaced apart from one another with a gap therebetween, wherein the gap has a slit-like shape. The wall 30 connects lower portions of the outer surfaces of the fins 20. A circular bottom edge of the wall 30 is coplanar with bottom edges of the fins 20. A circular top edge of the wall 30 is located at a middle portion of the fins 30 along an axial direction of the body 10. The wall 30, the fins 20 and the absorbing portion 12 together define a plurality of channels each occupying a lower portion of a corresponding gap between two neighboring fins 20. Each channel has a lower opening 80 at the bottom of the heat sink 100 and a top opening 50 at the top edge of the wall 30.

The LEDs 210 of the LED module 200 are installed onto the printed circuit board 220 and electrically connected to circuits (not shown) provided on the printed circuit board 220. The printed circuit board 220 is further electrically connected to a power source (not shown) through wires (not shown) extending though the through holes 40 of the body 10.

According to the present invention, heat produced by the LEDs 210 can be quickly transferred to the heat sink 100 via a thermal connection between the LED module 200 and the absorbing portion 12 of the body 10 of the heat sink 100. An electrically insulative and thermally conductive interface material (not shown), for example, thermal grease is used to fill a space between the ceiling of the absorbing portion 12 and the printed circuit board 220, whereby the heat generated by the LEDs 210 can be readily transferred to the absorbing portion 12. The heat produced by the LEDs 210 is transferred to the fins 20 via the body 10 of the heat sink 100, and is then dissipated away to ambient air via the fins 20. The air in the channels defined by the outer surface of the body 10, the fins 20 and the wall 30 of the heat sink 100 is heated. The channels each function as a chimney for guiding the heated air to flow upwardly through the gaps between the fins 20 via the top openings 50. The heated air is replaced by outside cooler air flowing from the lower openings 80 of the heat sink 100 into the channels. By the provision of the channels, a natural air convection through the gaps between the fins 20 can be accelerated, whereby the heat dissipation efficiency of the heat sink 100 can be improved. Furthermore, since upper portions of the fins 20 are exposed outwardly to surrounding air, the heated air which has flowed to the upper portions of the fins 20 can easily flow away from the fins 20 upwardly or outwardly. Thus, the heat produced by the LEDs 210 can be removed by the heat sink 100 very quickly, thereby enabling the LEDs 210 to work within a required temperature range.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a heat sink comprising a body having an absorbing portion and a transferring portion extending upwardly from the absorbing portion, a plurality of radial partition fins extending evenly from an outer periphery of the absorbing portion and the transferring portion of the body, a curved wall surrounding lower portions of the fins, the fins, the outer periphery of the body and the curved wall together defining a plurality of channels each having a lower opening and a top opening; and an LED module comprising a plurality of LEDs, being received in the absorbing portion of the body, the LED module being attached to the absorbing portion and having a thermal connection therewith;

wherein the fins each have a convex outer surface, whereby the heat sink has a bowl-shaped configuration; and wherein the fins each have a flat top face coplanar with a top face of the transferring portion and a bottom face coplanar with a bottom face of the absorbing portion.

2. The LED lamp as described in claim 1, wherein the curved wall connects a lower portion of the outer surface of each of the fins.

3. The LED lamp as described in claim 2, wherein the curved wall has a bottom edge coplanar with bottom edges of the fins, the lower openings of the heat sink being defined by the fins, the body and the bottom edge of the curved wall.

4. The LED lamp as described in claim 2, wherein the curved wall has a top edge in middle portions of the fins, the top openings of the channels of the heat sink being defined by the fins, the body and the top edge of the curved wall.

5. The LED lamp as described in claim 1, wherein the absorbing portion and the transferring portion each have a cylindrical configuration and have a common axis.

6. The LED lamp as described in claim 5, wherein a diameter of the transferring portion is smaller than that of the absorbing portion.

7. The LED lamp as described in claim 6, wherein the transferring portion extends a mounting portion upwardly from an upper portion thereof, a diameter of the mounting portion being smaller than that of the transferring portion.

8. The LED lamp as described in claim 5, wherein the absorbing portion defines a cylindrical cavity in a bottom thereof to form a ceiling in the cavity, the LED module being mounted on the ceiling.

9. The LED lamp as described in claim 1, wherein the curved wall has a configuration of a hollow frustum.

10. A heat sink for removing heat from an LED module having LEDs, the heat sink comprising:

a body having an absorbing portion receiving the LED module and a transferring portion extending upwardly from the absorbing portion;

a plurality of radial partition fins extending evenly from an outer periphery of the body, the fins each having a convex outer surface; and a curved wall surrounding and connecting a lower portion of the convex outer surface of each of the fins, the fins, the outer periphery of the body and the curved wall together defining a plurality of channels each having a lower opening and a top opening;

wherein air flows from the lower opening to the top opening for removing heat from the heat sink when the heat sink absorbs the heat from the LED module;

wherein the fins each have a flat top face coplanar with a top face of the transferring portion and a bottom face coplanar with a bottom face of the absorbing portion.

11. The heat sink as described in claim 10, wherein the heat sink has a bowl-shaped configuration.

12. The heat sink as described in claim 10, wherein the curved wall has a top edge located at a middle portion of the outer surface of each of the fins.

13. An LED lamp comprising:

a heat sink having a central body defining a lower recess, a plurality of fins extending outwardly from a periphery of the central body wherein every two neighboring fins defines a gap therebetween, and a wall enclosing lower portions of the fins whereby a plurality of channels is defined between the lower portions of the fins, the wall and a lower portion of the periphery of the central body, each channel occupying a lower portion of a corresponding gap; and an LED module having a printed circuit board and a plurality of LEDs mounted to the printed circuit board, wherein the printed circuit board is received in the recess of the central body and thermally connects with the central body;

wherein the fins each have a flat top face coplanar with a top face of the central body and a bottom face coplanar with a bottom face of the central body.

* * * * *